US007336797B2

(12) United States Patent
Thompson et al.

(10) Patent No.: US 7,336,797 B2
(45) Date of Patent: Feb. 26, 2008

(54) APPARATUS AND METHOD FOR GENERATING ACOUSTIC ENERGY IN A RECEIVER ASSEMBLY

(75) Inventors: Stephen C. Thompson, Naperville, IL (US); David E. Schafer, Glen Ellyn, IL (US); Daniel M. Warren, Geneva, IL (US)

(73) Assignee: Knowles Electronics, LLC., Itasca, IL (US)

( * ) Notice: Subject to any disclaimer, the term of this patent is extended or adjusted under 35 U.S.C. 154(b) by 359 days.

(21) Appl. No.: 10/842,654

(22) Filed: May 10, 2004

(65) Prior Publication Data

US 2004/0258260 A1 Dec. 23, 2004

Related U.S. Application Data

(60) Provisional application No. 60/469,154, filed on May 9, 2003.

(51) Int. Cl.
*H04R 11/02* (2006.01)

(52) U.S. Cl. ..... 381/418; 381/417; 381/324

(58) Field of Classification Search ..... 381/417, 381/418, 312–331

See application file for complete search history.

(56) References Cited

U.S. PATENT DOCUMENTS

| | | | | |
|---|---|---|---|---|
| 1,630,009 | A | 5/1927 | Hopkins | |
| 1,744,032 | A | 1/1930 | Baldwin | |
| 1,950,857 | A | 3/1934 | McGall | |
| 2,496,483 | A * | 2/1950 | Massa | 381/166 |
| 3,515,818 | A * | 6/1970 | Tibbetts | 381/189 |
| 5,246,353 | A * | 9/1993 | Sohn | 417/413.1 |
| 6,658,134 | B1 * | 12/2003 | van Hal et al. | 381/418 |
| 2001/0011615 | A1 * | 8/2001 | Iwasa et al. | 181/172 |
| 2001/0012375 | A1 | 8/2001 | Miller et al. | |
| 2003/0048920 | A1 | 3/2003 | Van Halteren et al. | |

FOREIGN PATENT DOCUMENTS

| | | |
|---|---|---|
| JP | 7-131893 | 5/1995 |
| JP | 11-308691 | 11/1999 |

OTHER PUBLICATIONS

Partial International Search Report for Application No. PCT/US04/014564 dated Dec. 20, 2004.

* cited by examiner

*Primary Examiner*—Sinh Tran
*Assistant Examiner*—Joseph Saunders, Jr.
(74) *Attorney, Agent, or Firm*—Marshall, Gerstein & Borun LLP

(57) ABSTRACT

A receiver assembly includes a housing having a fixed housing portion and a shiftable housing portion cooperating to define a hollow cavity. A flexible membrane secured between the fixed housing portion and the shiftable housing portion and adapted to allow relative motion between the fixed and shiftable housing portions. The receiver assembly further includes a magnetic motor assembly including a displaceable drive rod; and a link assembly having a first end fixedly attached to an inner surface of the shiftable housing and a second end coupled to the drive rod. The link assembly translates the shiftable housing portion relative to the fixed housing portion in response to the displacement of the drive rod.

25 Claims, 12 Drawing Sheets

APPARATUS AND METHOD FOR GENERATING ACOUSTIC ENERGY IN A RECEIVER ASSEMBLY

CROSS-REFERENCE TO RELATED PATENT APPLICATION

This patent claims the benefit of U.S. Provisional Application No. 60/469,154, filed May 9, 2003, the disclosure of which is hereby incorporated herein by reference in its entirety for all purposes.

Further this patent is related to U.S. patent application Ser. No. 10/842,663, filed concurrently (May. 10, 2004), entitled "Apparatus and Method for Generating Acoustic Energy in a Receiver Assembly", the disclosure of which is hereby expressly incorporated herein by reference in its entirety for all purposes.

TECHNICAL FIELD

This patent generally relates to receivers used in listening devices, such as hearing aids or the like, and more particularly, to a diaphragm assembly for use in a vibration-balanced receiver assembly capable of maintaining performance within a predetermined frequency range and a method of manufacturing the same.

BACKGROUND

Hearing aid technology has progressed rapidly in recent years. Technological advancements in this field continue to improve the reception, wearing-comfort, life-span, and power efficiency of hearing aids. With these continual advances in the performance of ear-worn acoustic devices, ever-increasing demands are placed upon improving the inherent performance of the miniature acoustic transducers that are utilized. There are several different hearing aid styles including: Behind-The-Ear (BTE), In-The-Ear or All In-The-Ear (ITE), In-The-Canal (ITC), and Completely-In-The-Canal (CTC).

Generally, a listening device, such as a hearing aid, includes a microphone assembly, an amplifier and a receiver (speaker) assembly. The microphone assembly receives vibration energy, i.e. acoustic sound waves in audible frequencies, and generates an electronic signal representative of these sound waves. The amplifier accepts the electronic signal, modifies the electronic signal, and communicates the modified electronic signal (e.g., processed signal) to the receiver assembly. The receiver assembly, in turn, converts the increased electronic signal into vibration energy for transmission to a user.

Conventionally, the receiver assembly utilizes moving parts (e.g., armature, diaphragm, etc.) to generate acoustic energy in the ear canal of the hearing aid wearer. If the receiver assembly is in contact with another hearing aid component, the momentum of these moving parts will be transferred from the receiver assembly to the component and from the component back to the microphone assembly. This transferred momentum or energy may then cause unintended electrical output from the microphone, i.e., feedback. This mechanism of unwanted feedback limits the amount of amplification that can be applied to the electric signal representing the received sound waves. In many situations, this limitation is detrimental to the performance of the hearing aid. Consequently, it is desirable to reduce the vibration and/or magnetic feedback that occurs in the receiver assembly of the hearing aid or other similar devices.

BRIEF DESCRIPTION OF THE DRAWINGS

For a more complete understanding of the disclosure, reference should be made to the following detailed description and accompanying drawings wherein.

DETAILED DESCRIPTION

Figure 1:
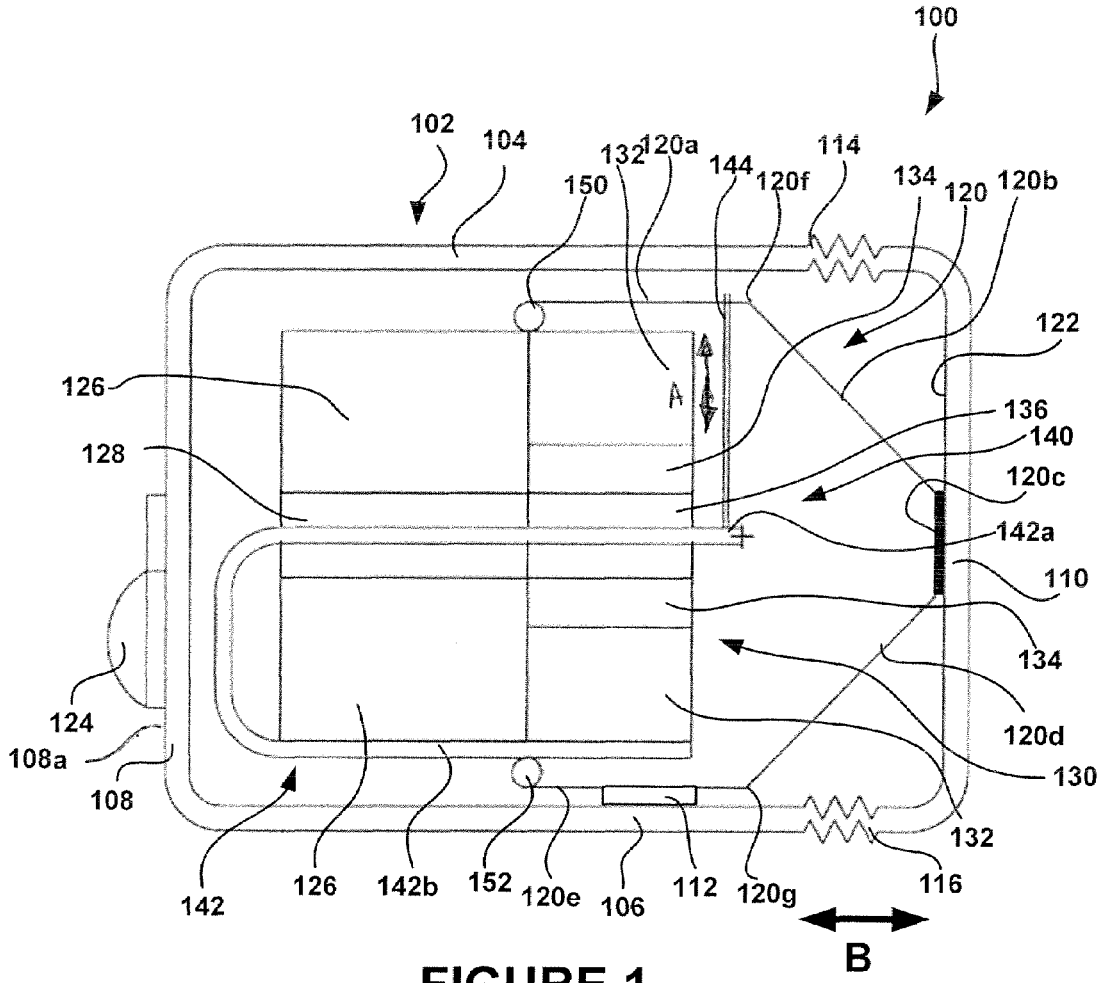
FIG. 1 is a cross-sectional view of an exemplary embodiment of a receiver assembly.

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

The following patent applications describe techniques that may be employed in certain embodiments of receiver assemblies: U.S. patent application Ser. No. 10/719,809, entitled "Apparatus For Creating Acoustic Energy In A Balanced Receiver Assembly And Manufacturing Method Thereof," filed on Nov. 21, 2003; U.S. patent application Ser. No. 10/719,765, entitled "Apparatus For Energy Transfer In A Balanced Receiver Assembly And Manufacturing Method Thereof," filed on Nov. 21, 2003; both applications claim the benefit of U.S. Provisional Patent Application No. 60/428,604, filed on Nov. 22, 2002; U.S. patent application Ser. No. 09/755,664, entitled "Vibration Balanced Receiver," filed on Jan. 5, 2001, is a continuation-in-part of the now-abandoned U.S. patent application Ser. No. 09/479,134, entitled "Vibration Balanced Receiver," filed Jan. 7, 2000, U.S. patent application Ser. No. 09/809,130, entitled "Vibration-Dampening Receiver Assembly", filed on Mar. 15, 2003. These patent applications are hereby incorporated by reference herein in their entireties for all purposes. It is to be understood, however, that the techniques described in these patent applications are not required.

Figure 2:
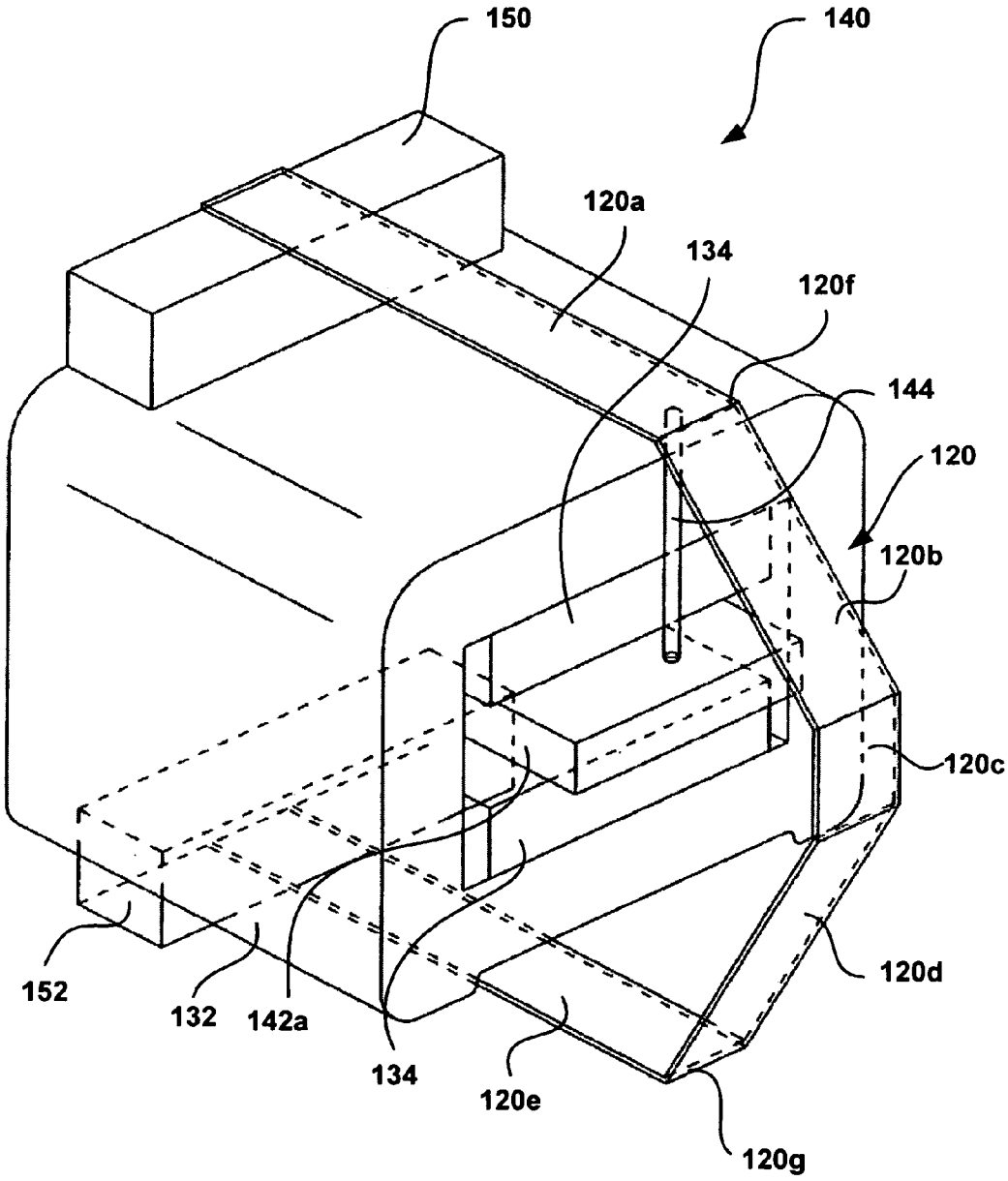
FIG. 2 is a perspective view of an exemplary motor assembly shown FIG. 1.

FIGS. 1 and 2 illustrate an exemplary embodiment of a receiver assembly 100. The receiver assembly 100 includes a housing 102 that may be, for example, rectangular in cross-section with a planar top 104, a bottom 106, and side walls 108, 110. In alternate embodiments, the housing 102 can be manufactured in a variety of configurations, such as, a cylindrical shape, a D-shape, a trapezoid shape, a roughly square shape, or any other desired geometry. In addition, the scale and size of the housing 102 may vary based on the intended application, operating conditions, required components, etc. Moreover, the housing 102 can be manufactured from a variety of materials, such as, for example, stainless steel, alternating layers of conductive materials, or alternating layers of non-conductive materials (e.g., metal particle-coated plastics). The bottom 106 of the housing 102 may include a plurality of supporting members 112 adapted to support both a magnet assembly 130 and a motor assembly 140. It will be understood that a variety of supporting structures such as, for example, a u-shape plate, a pair of deformed corners, or a glue fillet, may be utilized to support the magnet assembly and motor assemblies 130, 140.

A first and second bellows-like member 114, 116 are provided in the surface of the housing 102 and allow motion in response to the flexing of a linkage assembly 120. The first and second bellows-like member 114, 116 may have an accordion like structure including a plurality of ridges and valleys, may be a pliant sheet of material, and may be any other type of flexible membrane capable of expanding and contracting in response to the flexure of the linkage assembly 120. For example, as is shown in the embodiment depicted in FIG. 1, the first bellows-like member 114 may be disposed in the top 104 of the housing 102, and the second bellows-like member 116 may be disposed in the bottom 106 of the housing 102. Separate housing sections incorporating the bellows-like members 114 and 116 may be provided, or the bellows-like members 114 and 116 may otherwise be provided within the housing 102. In other words, the bellows-like members 114, 116 may be incorporated separately into the top 104 and the bottom 106, respectively, or can be a single flexible membrane disposed and joining a fixed portion of the housing 102 to a moveable portion of the housing 102. In operation, the first and second bellows-like member 114,116 allow movement of a radiating face or piston diaphragm 122 in response to the movement of the linkage assembly 120 to thereby pump or force air.

The radiating face or piston diaphragm 122 attaches to the inner surface of the side wall 110 by bonding or any other suitable method of attachment. The radiating face 122 translates relative to the housing 102 in accordance with the movement of the linkage assembly 120 driving the first and second bellows-like members 114, 116. The radiating face 122 may be manufactured from mylar or other suitable material of suitable stiffness and rigidity to provide an output acoustical signal of the receiver assembly 100 that corresponds to the input audio signal received at an electrical terminal 124 positioned on an external surface 108*a* of the side wall 108.

The receiver assembly 100 further includes a drive coil 126 having a central channel defining a first air gap 128 therethrough. The illustrated drive coil 126 is sized to conform to the shape of the housing 102, but may produced in a variety of shapes and sizes that may or may not correspond to the housing shape. For example, in one embodiment the drive coil 126 may be manufactured having an overall rectangular shape to correspond to the rectangular shape of the housing 102. The drive coil 126 is made of electrically conductive materials having a thickness and a plurality of turns such as the drive coil disclosed in U.S. patent application Ser. No. 09/928,673, entitled "Low Capacitance Receiver Coil," filed on Aug. 21, 2001, the disclosure of which is hereby incorporated herein by reference in its entirety for all purposes. In alternate embodiments, the drive coil 126 may be made of alternating layers of insulating materials (e.g. copper-polymer based film).

The receiver assembly 100 further includes a magnet assembly 130 including a pair of drive magnets 134 fixedly attached to a magnetic yoke 132. The magnet assembly 130 may generally be shaped to correspond to the shape and configuration of the housing 102, but may be in various shapes and sizes. The magnetic yoke 132 forms a rectangular frame having a central tunnel or channel defining an enclosure into which the drive magnets 134 mount and form a second air gap 136.

The magnetic yoke 132 may be manufactured of soft magnetic materials having a high permeability and a high saturation induction such as, for example, nickel-iron alloy, iron-silicon alloy, or cobalt-iron vanadium alloy, having a thickness to carry the electromagnetic flux of the drive magnets 134 and the drive coil 126. The drive magnets 134 may be manufactured from a variety of materials, such as, for example, a permanent magnet material (e.g., aluminum-nickel-cobalt, ferrite), a rare earth magnet material such as, for example samarium-cobalt (SmCo), neodymium-iron-boron (NdFeB), having a thickness to provide sufficient electromagnetic flux density within the second air gap 136.

The receiver assembly 100 further includes a motor assembly 140 including an armature 142, a link or drive rod 144, and at least one member of the linkage assembly 120. The linkage assembly 120 is shown generally semi-lateral, having a plurality of linear link members 120*a*, 120*b*, 120*c*, 120*d*, 120*e* and vertices 120*f*, 120*g*. The linkage assembly 120 may be formed into a variety of shapes and configurations based on the intended application, operating conditions, required components, etc. The linkage assembly 120 may be fabricated from a flat stock material such as a thin strip of metal or foil having a surface that defines a plane, and a width that is perpendicular to the plane. Alternately, the linkage assembly 120 may be formed of plastic or some other pliant material. Each of the link members 120*a*, 120*b*, 120*c*, 120*d*, 120*e* is illustrated as a substantially flat or linear component connected together at the vertices 120*f*, 120*g*. The transitions from one link member (e.g. 120*e* to 120*d*, and 120*a* to 120*b*) to another link member may be abrupt and sharply angled such as shown at the exemplary vertices 120*f*, 120*g*, or may be curved, or even expanded to include at least one short span, such as a link vertex 120*c*.

The armature 142 may be configured as a generally U-shaped strap having first and second opposing legs 142*a*, 142*b*, respectively. One skilled in the art will appreciate the principles and advantages of the embodiments described herein may be useful with all types of receivers, such as, for example, receivers employing an E-shaped armature. The armature 142 extends through the first air gap 128 of the drive coil 126 and the second air gap 136 of the magnet assembly 130. The drive rod 144, attached to the armature 142 adjacent to the free end of the first leg 142*a*, is positioned within the housing 102. The drive rod 144, in turn, couples to the inner surface of the link member 120*a*, for example by adhesive bonding, and hence to the remainder of the drive linkage assembly 120. In alternate embodiments, the link member 120*a* may include an aperture to allow the drive rod 144 to extend therethrough and slideably couples the link member 120*a* to the linkage assembly 120. The magnet assembly 130 surrounds the first leg 142*a* of the armature 142 and provides a permanent magnetic field within the second air gap 136.

At least one mounting member or spacer, two are illustrated as mounting members 150, 152 are introduced to support and secure the linkage assembly 120. The mounting members 150, 152 may be adhesive bumps, may be formed portions of the housing 102, and may be sized to space the linkage assembly 120 away from the magnet assembly 130 and the housing 102. The thickness and material of the mounting members 150, 152 may vary depending on the requirements of the application. It will be understood that a variety of mounting members such as, for example, a glue fillet, may be utilized to support the linkage assembly. In alternate embodiment, a spacer (not depicted) having a hollow section may be placed between the linkage assembly 120 and the magnet assembly 130 to support the linkage assembly 120.

The outer surface of the mounting member 150 secures to the inner surface of the member 120*a* by bonding or any other suitable method of attachment, and the inner surface of the mounting member 150 secures to the outer surface of the magnet assembly 130 by bonding or any other suitable method of attachment. Similarly, the inner surface of the mounting member 152 secures to the outer surface of the second leg 142*b* of the armature 142 by bonding or any other suitable method of attachment, and the outer surface of the mounting member 152 secures to the inner surface of the member 120*e* by bonding or any other suitable method of attachment.

In operation, excitation of the drive coil 126 (as shown in FIG. 1) magnetizes the armature 142. Interaction of the first leg 142*a* with the magnetic field causes the first leg 142*a* of the armature 142 to vibrate, which leads to the movement of the drive rod 144. When the drive rod 144 moves a first direction (e.g. up and down, as shown by the arrow ), the link members 120*a*, 120*b*, 120*c*, 120*d*, 120*e*, 120*f*, and 120*g* of the linkage assembly 120 move in response to the drive rod 144. The motion of the drive rod 144 is converted into at vertex 120*c* of the linkage assembly 120, resulting in motion in a second direction (e.g., movement in the direction shown by the arrow B) of the radiating face 122 of the housing 102. As an example, upward movement by the first leg 142*a* generates a movement of the drive rod 144 substantially aligned with the first direction, which in turn, generates a movement of vertex 120*c* substantially aligned with the second direction, resulting in movement of the radiating face 122 of the housing 102.

The bellow-like members 114, 116 of the housing 102 as shown in FIG. 1 enclosed the drive coil 126, the magnet assembly 130, and the motor assembly 140 from the outside, but allow the radiating face 122 to move freely in the second direction (as shown by the arrow B). Formed in this manner, the receiver assembly 100 has the advantage of radiating an increased amount of output acoustical signal without a conventional diaphragm and a sound port. In addition, the sound port may be eliminated, thus allowing the receiver assembly 100 to be less susceptible to the accumulation of cerumen and moisture. A device built in accordance with the embodiment illustrated in FIGS. 1 and 2, has the advantage of reduced overall size while providing improved performance characteristics such as sensitivity, noise, stability, compactness, robustness, maintaining high degree of reproducibility and other external and environmental conditions (including shock and debris).

Figure 3:
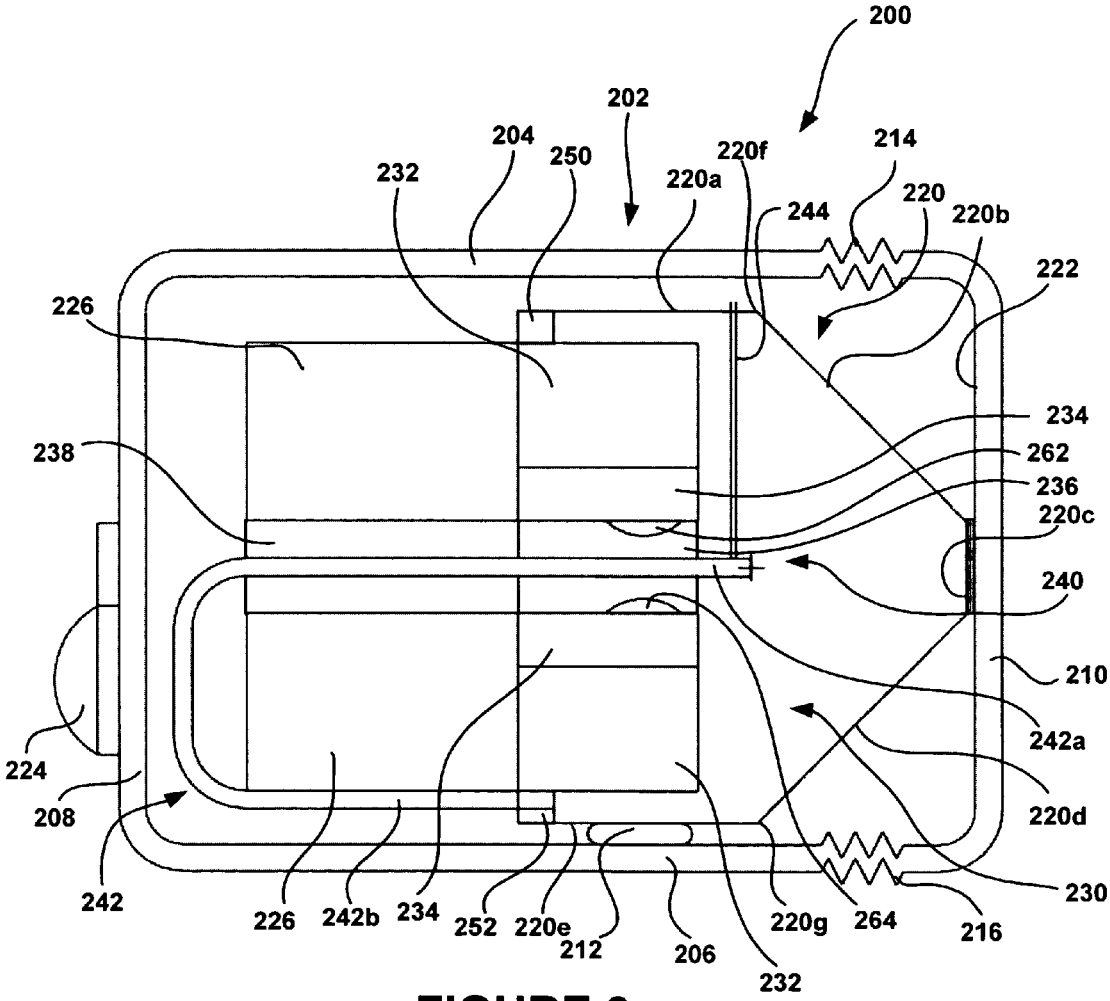
FIG. 3 is a cross-sectional view of another embodiment of a receiver assembly.

Referring now to FIG. 3, a receiver assembly 200 in accordance with another embodiment of the invention is illustrated. The assembly 200 is similar in construction and function as the assembly 100 illustrated in FIG. 1, and like elements are referred to using like reference numerals wherein, for example 200 and 226 correspond to 100 and 126, respectively. A first and second formation 262, 264 are positioned on opposing sides of the inner surface of the magnet assembly 230 to prevent the first leg 242*a* of the armature 242 from striking or directly contacting the drive magnet 234, which in turn, stabilizes the radiating face 222 of the housing 202. The formations 262, 264 may be constructed of adhesive or other settable material to provide shock resistance for the receiver assembly 200 by inhibiting large deflections of the first armature leg 242*a*. The formations or bumpers 262, 264 may protect the first armature leg 242*a* as disclosed in U.S. application Ser. No. 10/089,861, entitled "Electro-Acoustic Transducer With Resistance to Shock-Waves" flied on Aug. 8, 2000, the disclosUre of which is hereby incorporated herein by reference in its entirety for all purposes.

However, the formations 262, 264 may take the form of various shapes, and have a number of different sizes in different embodiments. Moreover, the formations 262, 264 can be manufactured from a variety of materials, such as, for example, damping fluid, an elastoner, an epoxy, or a plastic. The damping fluid may be a shock resistant fluid contained within the gap 236 such as disclosed in U.S. Pat. No. 6,041,131, entitled "Shock Resistant Electroacoustic Transducer," issued on Mar. 21, 2000, the disclosure of which is hereby incorporated herein by reference in its entirety for all purposes. In operation, the formations 262, 264 improve resistance of the receiver assembly 200 during insertion, removal, and cleaning of the ceruman accumulation on the outside of the housing 202. In alternate embodiments, the formations may be manufactured on the inner surface of the drive coil 226, on the first armature 242*a* within the first air gap 228, on the first armature 242*a* within the second air gap 236, or on both.

Figure 4:
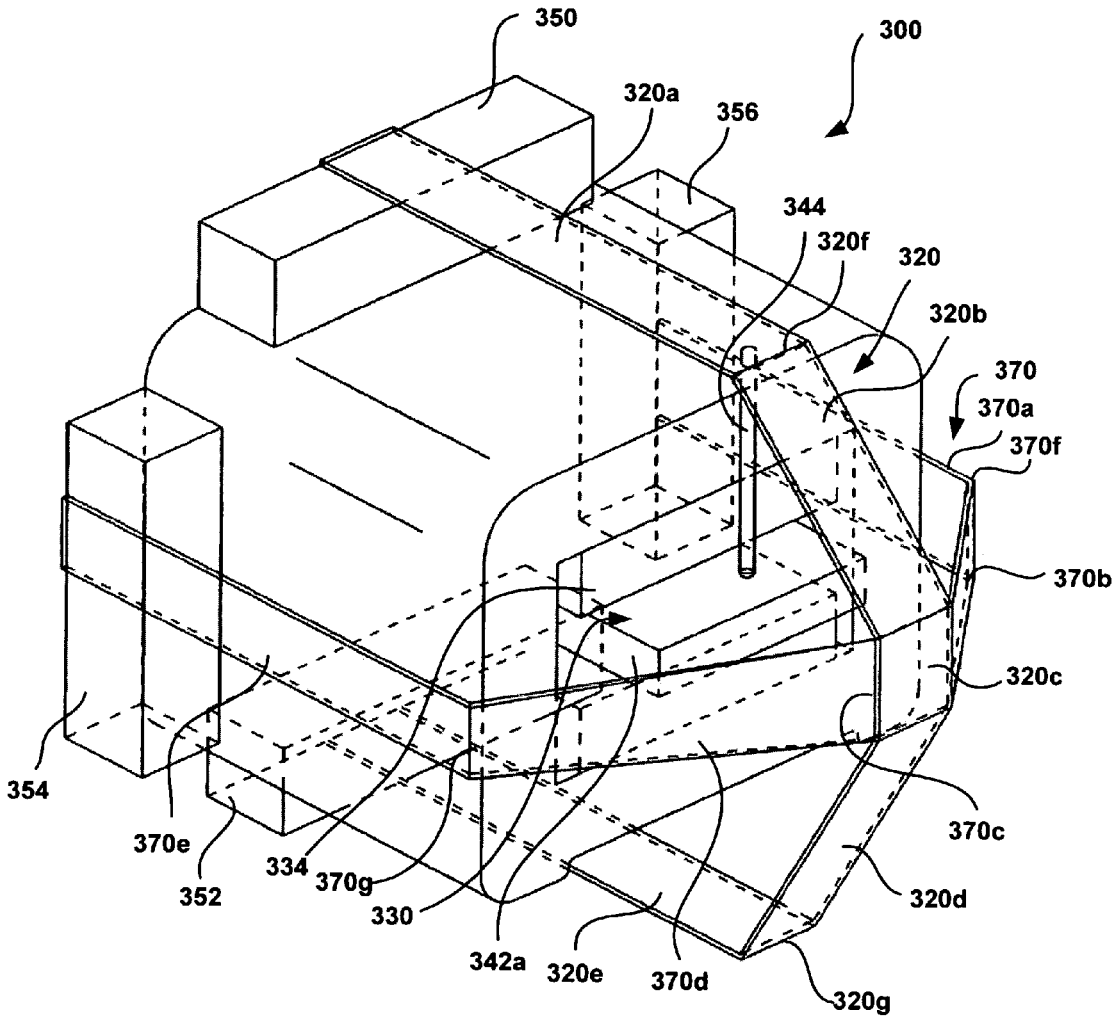
FIG. 4 is a perspective view of another embodiment of a motor assembly.

Referring now to FIG. 4, a receiver assembly 300 in accordance with a yet another embodiment of the invention is illustrated. The assembly 300 is similar in construction and function as the assembly 100 illustrated in FIG. 1, and like elements are referred to using like reference numerals wherein, for example 300 and 326 correspond to 100 and 126, respectively. A second linkage assembly 370 is introduced to restrain inward motion of the radiating face 354, i.e. motion associated with the second direction (see arrow B of FIG. 1). The second linkage assembly 370 is shown generally semi-lateral, having a plurality of link members 370*a*, 370*b*, 370*c*, 37*d*, 370*e* and vertices 370*f*, 370*g*. The second linkage assembly 370 may take the form of various shapes and configurations based on the intended application, operating conditions, required components, etc. The linkage assembly 370 may be fabricated from a flat stock material such as a thin strip of metal or foil having a surface that defines a plane, and a width that is perpendicular to the plane. Alternately, the linkage assembly 370 may be formed of plastic or some other material. The link members 370*a*, 370*b*, 370*c*, 370*d*, 370*e* are shown substantially straight and connected together at the vertices 370*f*, 370*g*. The transitions from one member to its neighbor may be abrupt and sharply angled such as illustrated by the vertices 370*f*, 370*g*, may be rounded, or may be rounded expanded and include at least one short span, such as the vertex 370*c*.

The outer surface of the vertex 370*c* fixedly or removeably attaches to the inner surface of the vertex 320*c* for example by adhesive bonding or other suitable attachment means. The inner surface of the vertex 370*c* is symmetrically located on the opposing side of the magnet assembly 330. In operation, excitation of the drive coil (not depicted) magnetizes the first armature leg 342*a*. Interaction of the first armature leg 342*a* with the magnetic field causes the first armature leg 342*a* to vibrate in the first direction (see arrow A of FIG. 1), which leads to movement of the drive rod 344. When the drive rod 344 moves in the first direction, the members of the first linkage assembly 320 move in response to the drive 344. The motion of the drive rod 344 is converted into the second direction at the vertex 320*c* of the first linkage assembly 320. The members of the second linkage assembly 370 prevent the link members 320*a*, 320*b*, 320*c*, 320*d*, and 320*e* of the first linkage assembly 320 from swinging back and forth in an uncontrolled manner. The motion at vertex 320*c* of the first linkage assembly 320 is transferred to the second linkage assembly 370 at the vertex 370*c* thereby resulting in motion of the radiating face (e.g., the radiating face 122 shown in FIG. 1) of the receiver assembly 300. Formed in this manner, the second linkage assembly 370 provides additional support and rigidity to the first linkage assembly 320 of the receiver assembly.

Figure 5:
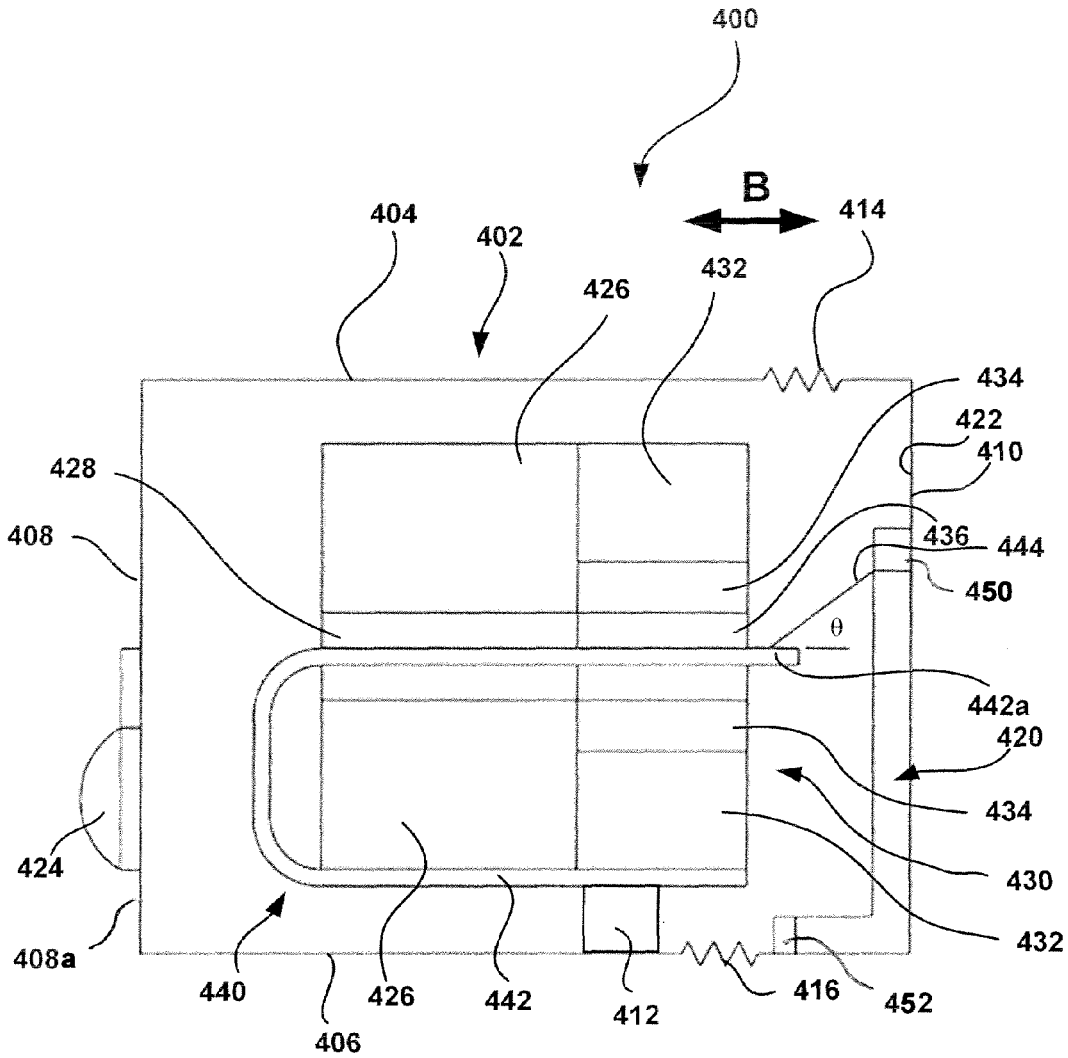
FIG. 5 is a cross-sectional view of an alternate embodiment of a receiver assembly.
Figure 6:
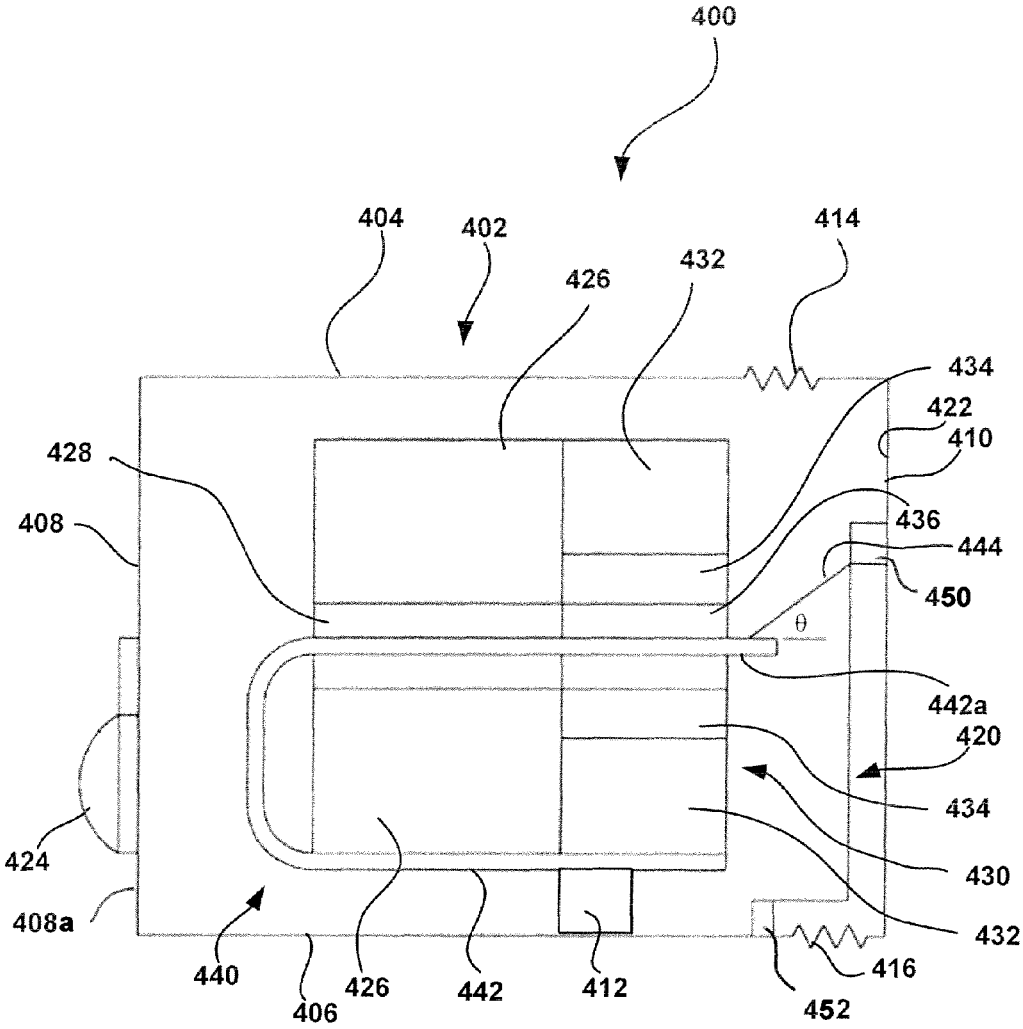
FIG. 6 is a cross-sectional view of another alternate embodiment of a receiver assembly.
Figure 7:
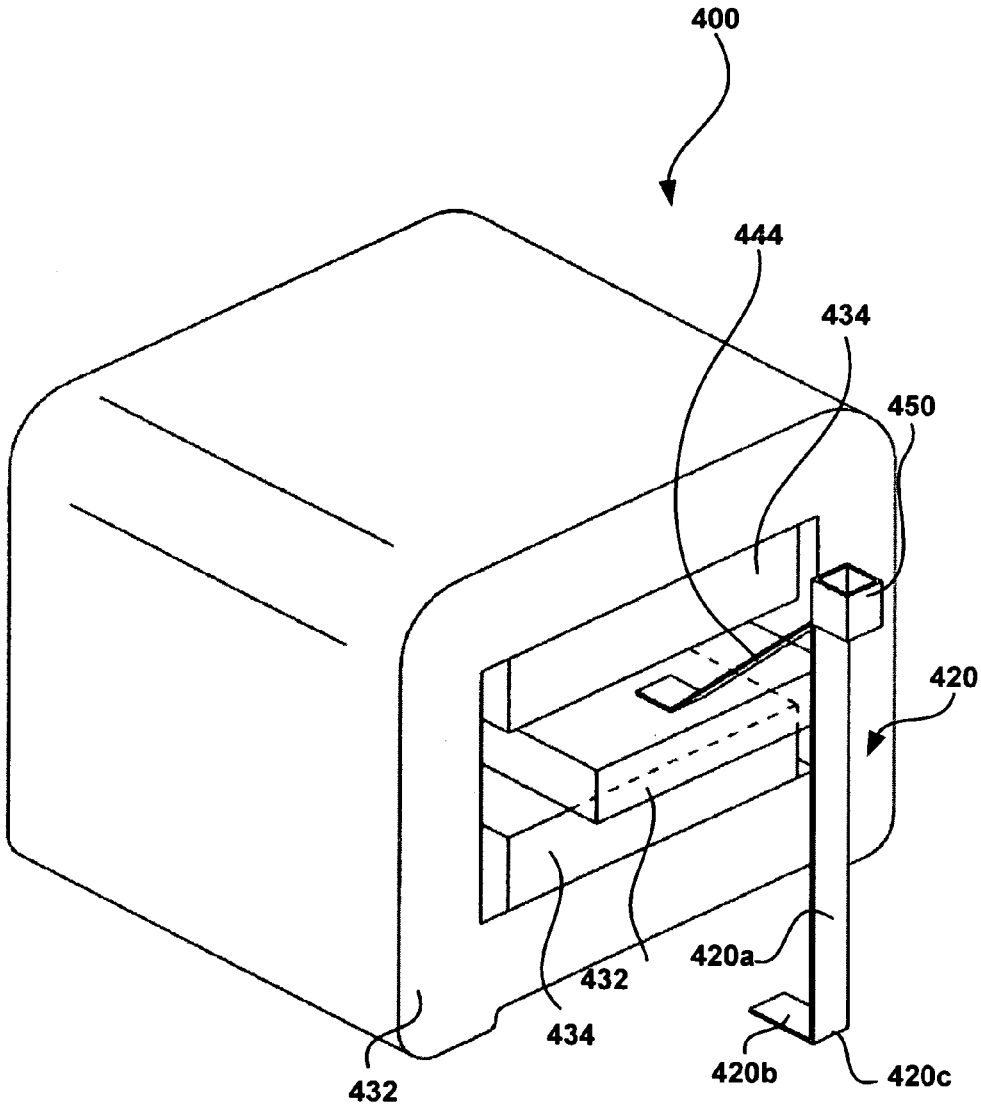
FIG. 7 is a perspective view of a motor assembly of shown FIGS. 5 and 6.

Referring now to FIGS. 5-7, a receiver assembly 400 in accordance with a described embodiment of the invention is illustrated. The assembly 400 is similar in construction and function as the assembly 100 illustrated in FIG. 1, and like elements are referred to using like reference numerals wherein, for example 400 and 426 correspond to 200 and 226, respectively. A first and second bellows-like member 414, 416 are provided in the surface of the housing 402 to allow or restrain motion in response to the motion of a linkage assembly 420. The first bellows-like member 414 may be formed integral to the planar top 404 of the housing 402, and the second bellows-like member 416 may be formed integral to the bottom 406 of the housing 402 and outside the linkage assembly 420. In operation, the first and second bellows-like member 414, 416 allow movement of a radiating face or piston diaphragm 422 in response to the movement of the linkage assembly 420 to thereby pump or force air.

The radiating face or piston diaphragm 422 attaches to the inner surface of the side wall 410 by bonding or any other suitable method of attachment. The radiating face 422 may be manufactured of mylar or other material of suitable stiffness and rigidity to provide output acoustical signals that corresponds to the input audio signal received at the electrical terminal 424 positioned on an external surface 408*a* of the side wall 408.

The receiver assembly 400 further includes a drive coil 426 having a central tunnel or channel defining a first air gap 428 therethrough. The drive coil 426 is sized to conform to the shape of the housing 402, but may be produced in a variety shapes and sizes that may or may not correspond to the housing shape. For example, in one embodiment the drive coil 426 may be manufactured having and overall rectangular shape corresponding to the rectangular shape of the housing 402. The drive coil 426 is made of electrically conductive materials having a thickness and a plurality of space turns such as the drive coil disclosed in U.S. patent application Ser. No. 09/928,673, entitled "Low Capacitance Receiver Coil," filed on Aug. 21, 2001, the disclosure of which is hereby incorporated herein by reference in its entirety for all purposes. In alternate embodiments, the drive coil 426 may be made of alternating layers of insulating materials (e.g., copper-polymer based film).

The receiver assembly 400 further includes a magnet assembly 430 including a drive magnet 434 fixedly attached to a magnetic yoke 432. The magnet assembly 430 may generally be shaped to correspond to the shape and configuration of the housing 402, but may be formed to compliment the various shapes and sizes of the different embodiments. The magnetic yoke 432 in the form of a rectangular frame having a relatively large central tunnel or channel forming an enclosure in which the drive magnet 434 are mounted in space relation to form a second air gap 434.

The magnetic yoke 432 is typically manufactured of magnetically conductive materials having a high permeability and a high saturation induction such as, for example, nickel-iron alloy, iron-silicon alloy, or cobalt-iron vanadium alloy, having a thickness to carry the electromagnetic flux of the drive magnet 434 and the drive coil 426. The drive magnet 434 is typically manufactured of a rare earth magnet material such as, for example samarium-cobalt (SmCo), neodymium-iron-boron (NdFeB), having a thickness to provide sufficient electromagnetic flux density within the second air gap 436.

The receiver assembly 400 further includes a motor assembly 440. The motor assembly 440 includes an armature 442, a link or drive rod 444, and at least one linkage assembly 420. The linkage assembly 420 is shown generally L-shape, having a plurality of link members 420*a*, 420*b* and vertex 420*c*. The linkage assembly 420 may take the form of various shapes and configurations based on the intended application, operating conditions, required components, etc. The linkage assembly 420 may be fabricated from a flat stock material such as a thin strip of metal or foil having a surface that defines a plane, and a width that is perpendicular to the plane. Alternately, the linkage assembly 420 may be formed of plastic or some other material. Each of the link members 420*a*, 420*b* are shown substantially straight and connected together at the vertex 420*c*. The transitions from one member to its neighbor may be abrupt and sharply angled such as the vertex 420*c*, or may be expanded and include at least one short span, such as a link vertex 420*b*.

The armature 442 is configured as a generally U-shaped strap having first and second opposed legs 442*a*, 442*b*, respectively. One skilled in the art will appreciate the principles and advantages of the embodiments described herein may be useful with all types of receives, such as those using an E-shaped armature. The armature 442 extends through the first air gap 428 of the drive coil 426 and the second air gap 436 of the magnet assembly 430. A drive rod 444, attached to the armature 442 adjacent to the free end of the first leg 442*a*, is positioned within the housing 402. The drive rod 444, in turn, couples to the inner surface of the link member 420*a*, for example by adhesive bonding, and hence to the remainder of the drive the linkage assembly 420. The drive rod 444 may be made of a strip of material, such as metal or plastic, capable of vibrating in response to the acoustical signal. In alternate embodiment, the linkage assembly 420 and the drive rod 444 can be formed from the same stock and molded or press-fit to the linkage assembly 420 as a single unit. The magnet assembly 430 surrounds the first leg 442*a* of the armature 442 and provides a permanent magnetic field within the second air gap 436.

At least one mounting member or spacer, two are illustrated as mounting members 450, 452 are introduced to support and secure the linkage assembly 420. The mounting members 450, 452 may be adhesive bumps, may be formed portions of the housing 102, and may be positioned between the linkage assembly 420 and the inner wall of the housing 402. The thickness and materials of the mounting members 450, 452 may vary depending on the requirements of the application. It will be understood that a variety of mounting members such as, for example, a glue fillet, may be utilized to support the linkage assembly 420.

The outer surface of the mounting member 450 secures to the surface of the member 420*a* by bonding or any suitable method of attachment, and the outer surface of the mounting member 450 is held in contact with the inner surface of the radiating face 422 by bonding or any suitable method of attachment. The outer surface of the mounting member 452 is held in contact with the inner surface of the bottom housing 106 by bonding or any suitable method of attachment. The outer surface of the mounting member 452 is held in contact with the surface of the member 420*c* by bonding or any other suitable method of attachment.

In operation, excitation of the drive coil 426 magnetizes the armature 442. Interaction of the first armature leg 442*a* with the magnetic field causes the first armature leg 442*a* to vibrate, which lead to the movement of the drive rod 444. When the drive rod 444 moves in response to the motion of the first armature leg 442*a* in the first direction, the link members 420*a*, 420*b*, and 420*c* of the linkage assembly 420 move in the second direction in response to the drive rod 444. The motion of the first armature leg 442*a* is converted at the drive rod 444 and the member 420*a* of the linkage assembly 420, resulting in motion of the radiating face 422 of the housing 402 in the second direction. As an example, the movement by the first armature leg 442*a* generates a movement of the drive rod 444 substantially aligned with the first direction, which in turn, generates a movement of member 420*a* of the linkage assembly 420 substantially aligned with the second direction, resulting the movement of the radiating face 422 of the housing 402. In other words, the movement of the first armature leg 442*a* can cause the drive rod 444 to move in the direction indicated by the theta symbol.

The first and the second bellows-like members 414, 416 of the housing 402 as shown in FIGS. 5 and 6 enclosed the drive coil 426, the magnet assembly 430, and the motor assembly 440 from the outside, but allow the radiating face 422 to move freely in horizontal motions (depicted as arrow B). Formed in this manner, the receiver assembly 400 has an increased amount of output acoustical signals without a conventional diaphragm and a sound port. In addition, the use of sound port is eliminated, thus allowing the receiver assembly 400 to be less susceptible to the accumulation of cerumen and moisture.

To further restrain large vibration in response to the vibration of the armature 442, the second bellows-like member 416 as shown in FIG. 6, is positioned inside the linkage assembly 420 to further restrain the motion of the mounting member 450 to a horizontal motion.

Figure 8:
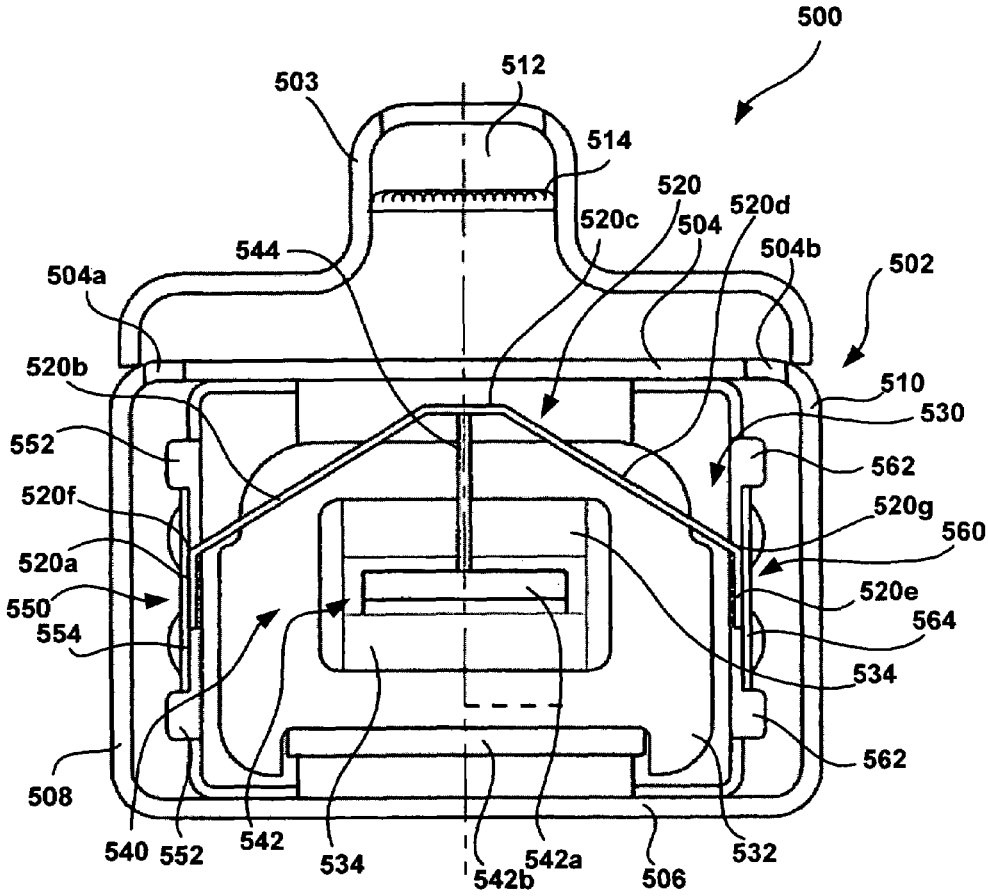
FIG. 8 is a front view of a described embodiment of a receiver assembly.

FIG. 8 illustrates another embodiment of a receiver assembly. The receiver assembly 500 includes a housing 502 having at least one sound outlet tube 503. The housing 502 may be generally rectangular with a top portion 504, a bottom portion 506, and side wall portions 508, 510. In alternate embodiments, the housing 502 can be manufactured in a variety of configurations, such as, a cylindrical shape, a D-shape, a trapezoid shape, a roughly square shape or any other desired geometry. In addition, the scale and size of the housing 502 may vary based on the intended application, operating conditions, required components, etc. Moreover, the housing 502 can be manufactured from a variety of materials, such as, for example stainless steel, alternating layers of conductive materials, alternating layers of non-conductive materials (e.g., metal particle-coated plastics), etc.

One or more apertures or acoustic ports 504*a*, 504*b* are introduced integral to the top portion 504 to broadcast an output acoustical signal that corresponds to an audio signal received at an electrical terminal. (not shown) positioned on an external surface of the housing 502. In alternate embodiment, the acoustic ports 504*a*, 504*b* can be formed in the side walls 508, 510. The acoustic ports 504*a*, 504*b* may be formed in any suitable manner such as drilling, punching or molding. A sound outlet tube 503 is coupled to the top portion 504 by bonding with adhesive or any other suitable method. In an alternate embodiment, the sound outlet tube 503 can be formed integral to the side walls 508, 510. The sound outlet tube 503 can be manufactured from a variety of materials such as, for example, stainless steel, alternating layers of conductive materials, alternating layers of non-conductive materials (e.g. metal particle-coated plastics), etc. The sound outlet tube 503 can be formed in various shapes and may have a number of different sizes. The sound outlet tube 503 comprises a sound passage 512 to guide the output acoustical signal via acoustic ports 504*a*, 504*b* towards the user's eardrum. The sound passage 512 may be formed in any suitable manner such as drilling, punching or molding. An optional damping element or filter 514 may be positioned within the sound passage 512. The damping element or filter 514 may provide an acoustical resistance to the receiver assembly 500, may improve the frequency response, may create delay, and may prevent debris from entering the receiver assembly 500. The receiver assembly 500 may further include a drive coil (not depicted) which may be located in side-by-side abutting alignment with a magnet assembly 530 within the housing 502 and an electrical terminal (not depicted) positioned on the external surface of the housing 502 for receiving an input audio frequency electrical signal.

The receiver assembly 500 further includes a magnet assembly 530 including a pair of drive magnets 534 fixedly attached to a magnetic yoke 532. The magnet assembly 530 may generally be shaped to correspond to the shape and configuration of the housing 502 but may be formed to compliment the various shapes and sizes of other embodiments. The magnetic yoke 532 forms of a generally rectangular frame having a central tunnel or channel defining an enclosure into which the drive magnets 534 may mount and form an air gap. The magnetic yoke 532 is typically manufactured of a soft magnetic material having a high permeability and a high saturation induction such as, for example, nickel-iron alloy, iron-silicon alloy, cobalt-iron vanadium alloy, etc., having a thickness to carry the electromagnetic flux of the drive magnets 534 and the drive coil (not depicted). The drive magnets 534 are typically manufactured of a magnetic material such as a permanent magnetic material (e.g., Alnico, Ferrite) or a rare earth magnet material such as, for example Samarium-Cobalt (SmCo), Neodymium-Iron-Boron (NdFeB), having a thickness to provide sufficient electromagnetic flux density within the air gap.

The receiver assembly 500 may further include a motor assembly 540 including an armature 542, a link or drive rod 544, and at least one linkage assembly 520. The linkage assembly 520 includes a plurality of link members 520*a*, 520*b*, 520*c*, 520*d*, 520*e* and vertices 520*f*, 520*g*. The linkage assembly 520 may be formed into a variety of shapes and configurations based on the intended application, operating conditions, required components, etc. The linkage assembly 520 is typically fabricated from a flat stock material such as a thin strip of metal or foil. Alternately, the linkage assembly 520 may be formed of plastic or some other material. Each of the link members 520*a*, 520*b*, 520*c*, 520*d*, 520*e* is illustrated as a substantially flat component connected together at the vertices 520*f*, 520*g*. The transitions from one link member to another link member may be abrupt and sharply angled such as shown at the exemplary vertices 520*f*, 520*g*, or may be curved or expanded and include at least one short span, such as the link member 520*c*. The armature 542 is configured as a generally U-shaped strap having first and second opposed legs 542*a*, 542*b*, respectively. In other embodiments, different types of armatures may be used such as E-shaped armatures. At least the leg 542*a* of the armature 542 extends through an air gap of the drive coil (not shown) and an air gap of the magnet assembly 530. One end of the drive rod 544 may be coupled to a free end of the first armature leg 542*a*. The other end of the drive rod 544 couples to an inner surface of the link member 520*c* by means of adhesive or any other suitable method. In an alternate embodiment, the member 520*c* may include an aperture to allow the drive rod 544 to extend therethrough and coupled to the member 520*c* by bonding or any other suitable method. Also, the linkage assembly 520 and the drive rod 544 can be formed from the same stock and molded or press-fit to the linkage assembly 520 to form one unit. The magnet assembly 530 provides a permanent magnetic field within the air gap of the of the drive magnet 534 through which the leg 542*a* if the armature 542 extends.

A first and second diaphragm assembly 550, 560 are introduced to increase the radiating area, each of whose reciprocating motion displaces air to produce acoustic output. The diaphragm assemblies 550, 560 include thin films 552, 562 and diaphragms 554, 564 attached to the thin films 552, 562. The diaphragm assemblies 550, 560 may have a generally rectangular shape that generally corresponds to that of the side portions 508, 510 but may take the form of various shapes and have a number of different of sizes in different embodiments. The diaphragm assemblies 550, 560 are secured to the outer surface of the magnet assembly 530 by bonding with adhesive or any other suitable attachment. In alternate embodiment, the diaphragm assemblies 550, 560 can be secured to the inner surface of the housing 502 by bonding with adhesive or any other suitable attachment. The diaphragms 554, 564 are shown to have at least one layer. However, the diaphragms 554, 564 may utilize multiple layers and coupled together by bonding with adhesive, compression, mechanical attachment at the edges, etc. The diaphragms 554, 564 can be manufactured from a variety of materials such as aluminum, stainless steel, beryllium copper, titanium, tungsten, platinum, copper, brass, or alloys thereof, non-metals such as modified ethylene vinyl acetate thermoplastic adhesive, thermo set adhesive, epoxy, polyimide (Kapton), plastic, plastic matrix, fiber reinforced plastic, etc., or multiples of these could be used. Formed in this manner, the diaphragm assemblies 550, 560 increase the radiating area to provide an output acoustical signal correspond to the input audio signal received at the electrical signal (not depicted) such that the acoustic pressures developed by the diaphragm assemblies 550, 560 are essentially in-phase with each other.

The diaphragm assemblies 550, 560 and the armature 542 are coupled to the linkage assembly 520. The first diaphragm assembly 550 is coupled to the linkage assembly 520 at or near the link member 520*a* by bonding or any other suitable method. The second diaphragm assembly 560 is coupled to the linkage assembly 520 at or near the link member 520*e* by bonding or any other suitable method.

In operation, excitation of the drive coil (not shown) in response to electronic signals at the electrical terminals (not shown) magnetizes the armature 542. Interaction of the first armature leg 542*a* with the magnetic field causes the first armature leg 542*a* to vibrate vertically, which leads to the movement of the drive rod 544. When the drive rod 544 moves in response to the vertical motion of the first armature leg 542*a*, the members of the linkage assembly 520 move in response to the drive rod 544. The vertical motion of the first armature leg 542*a* is converted into lateral motion at the members 520*a*, 520*e* of the linkage assembly 520, resulting in lateral motion of the diaphragms 554, 564 substantially perpendicular to the vertical motion of the first armature leg 542*a*. As an example, upward vertical movement by the first armature leg 542*a* in the direction F generates upward vertical movement of the drive rod 544 in the direction F, which in turn, generates upward vertical movement at member 520*c* of the linkage assembly 520 in the direction F. The upward vertical movement at member 520*c* of the linkage assembly 520 causes members 520*a*, 520*e* of the linkage assembly 520 to move inwardly toward each other generally perpendicular to the direction F, which in turn, causes the diaphragm 554 and the diaphragm 564 to move inwardly toward each other generally perpendicular to the direction F.

Figure 9:
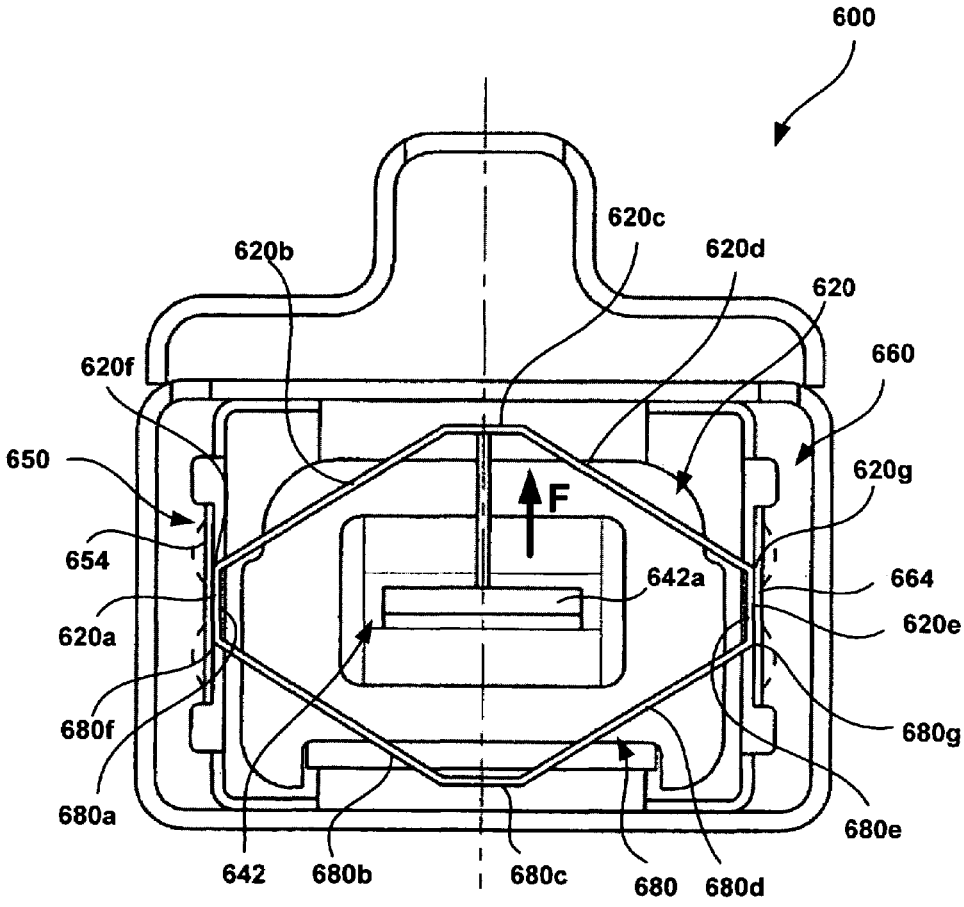
FIG. 9 is a front view of another described embodiment of a receiver assembly.

FIG. 9 illustrates yet another embodiment of a receiver assembly. The assembly 600 is similar in construction and function as the assembly 500 illustrated in FIG. 8, and similar elements are referred to using like reference numerals wherein, for example 600 and 650 correspond to 500 and 550, respectively. In this embodiment, a second linkage assembly 680 is introduced. The second linkage assembly 680 includes a plurality of link members 680*a*, 680*b*, 680*c*, 680*d*, 680*e* and vertices 680*f*, 680*g*. The second linkage assembly 680 may take the form of various shapes and configurations based on the intended application, operating conditions, required components, etc. The linkage assembly 680 is typically fabricated from a flat stock material such as a thin strip of metal or foil. Alternately, the linkage assembly 680 may be formed of plastic or some other material. Each of the link members 680*a*, 680*b*, 680*c*, 680*d*, 680*e* is illustrated as a substantially flat component connected together at the vertices 680*f*, 680*g*. The transitions from one link member to another link member may be abrupt and sharply angled such as 680*f*, 680*g*, or may be curved or even expanded and include at least one short span, such as vertex 680*c*. An outer surface of the vertex 680*a* may be coupled to an inner surface of the vertex 620*a* by bonding or any other suitable method. An outer surface of the vertex 680*e* may be coupled to an inner surface of the vertex 620*e* by bonding or any other suitable method. Alternatively, the first linkage assembly 620 and the second linkage assembly 680 can be formed from the same stock and molded or press-fit to the linkage assembly 620 to form one unit.

In operation, excitation of the drive coil (not shown) in response to the modified electronic signals at the electrical terminals (not shown) magnetizes the armature 642. Interaction of the first armature leg 642*a* with the magnetic field causes the first armature leg 642*a* to vibrate, which lead to the movement of the drive rod 644. When the drive rod 644 moves in response to a vertical motion F of the first armature leg 642*a*, the members of the linkage assemblies 620, 680 move in response to the drive rod 644. The vertical motion of the first armature leg 642*a* is converted into lateral motion at the members 620*a*, 620*e* of the first linkage assembly 620 and members 680*a*, 680*e* of the second linkage assembly 680, resulting in lateral motion of the diaphragm assemblies 650, 660 substantially perpendicular to the vertical motion of the first armature leg 642*a*. As an example, vertical movement by the first armature leg 642*a* in the direction F generates upward vertical movement of the drive rod 644 in the direction F, which in turn, generates upward vertical movement at members 620*c*, 680*c* of the first and second linkage assemblies 620, 680 in the direction F. The upward vertical movement at members 620*c*, 680*c* causes members 620*a*, 680*a* to move inwardly towards members 620*e*, 680*e*, and causes members 620*e*, 680*e* to move inwardly towards members 62*a*, 680*a*. This in turn causes diaphragms 654, 664 to move inwardly toward each other. In another embodiment, an additional mass can be attached, for example, to the member 680*c* of the second linkage assembly 680 to help decrease vibration of the receiver assembly 600.

Figure 10:
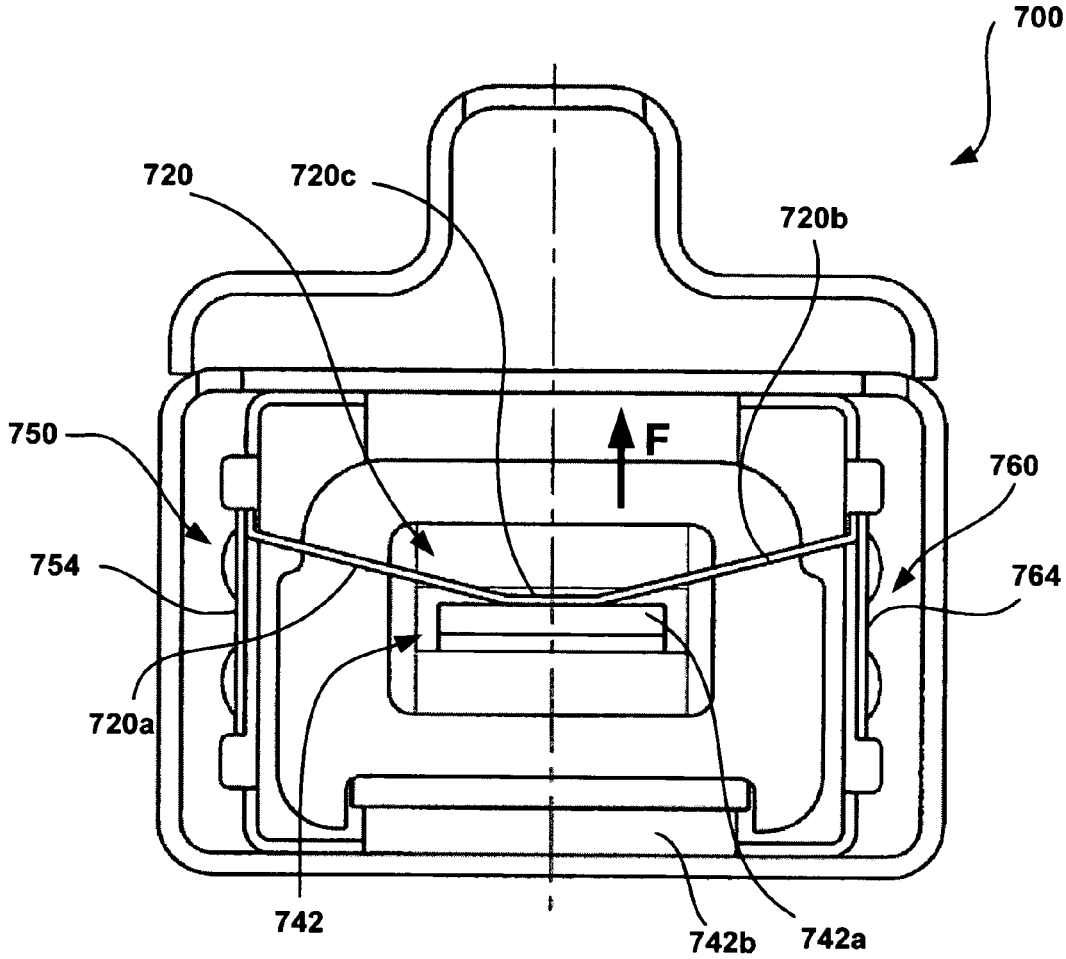
FIG. 10 is a front view of another described embodiment of a receiver assembly.

FIG. 10 illustrates still another embodiment of a receiver assembly. The assembly 700 is similar in construction and function as the assembly 500 illustrated in FIG. 8, and similar elements are referred to using like reference numerals wherein, for example 700 and 750 correspond to 500 and 550, respectively. In this embodiment, a drive rod such as the drive rod 544 as shown in FIG. 8 is not required, but rather a linkage assembly 720 is coupled to an armature 742. The linkage assembly 720 may include link members 720*a*, 720*b*, and 720*c*, and a bottom surface of the link member 720*c* may be coupled to a top surface of the armature leg 742*a*. Vertical movement of the armature leg 742*a* in the direction F generates upward vertical movement of the member 720*c* in the direction F, resulting in movement of the diaphragms 754, 764 generally perpendicular to the direction F and generally outwardly away from each other. In another embodiment, a bottom surface of the armature leg 742*a* may be coupled to a top surface of the link member 720*c*. Also, the linkage assembly 720 could be positioned such that movement of the armature leg 742*a* in the direction F would cause movement of the diaphragms 754, 764 generally inwardly toward each other.

Figure 11:
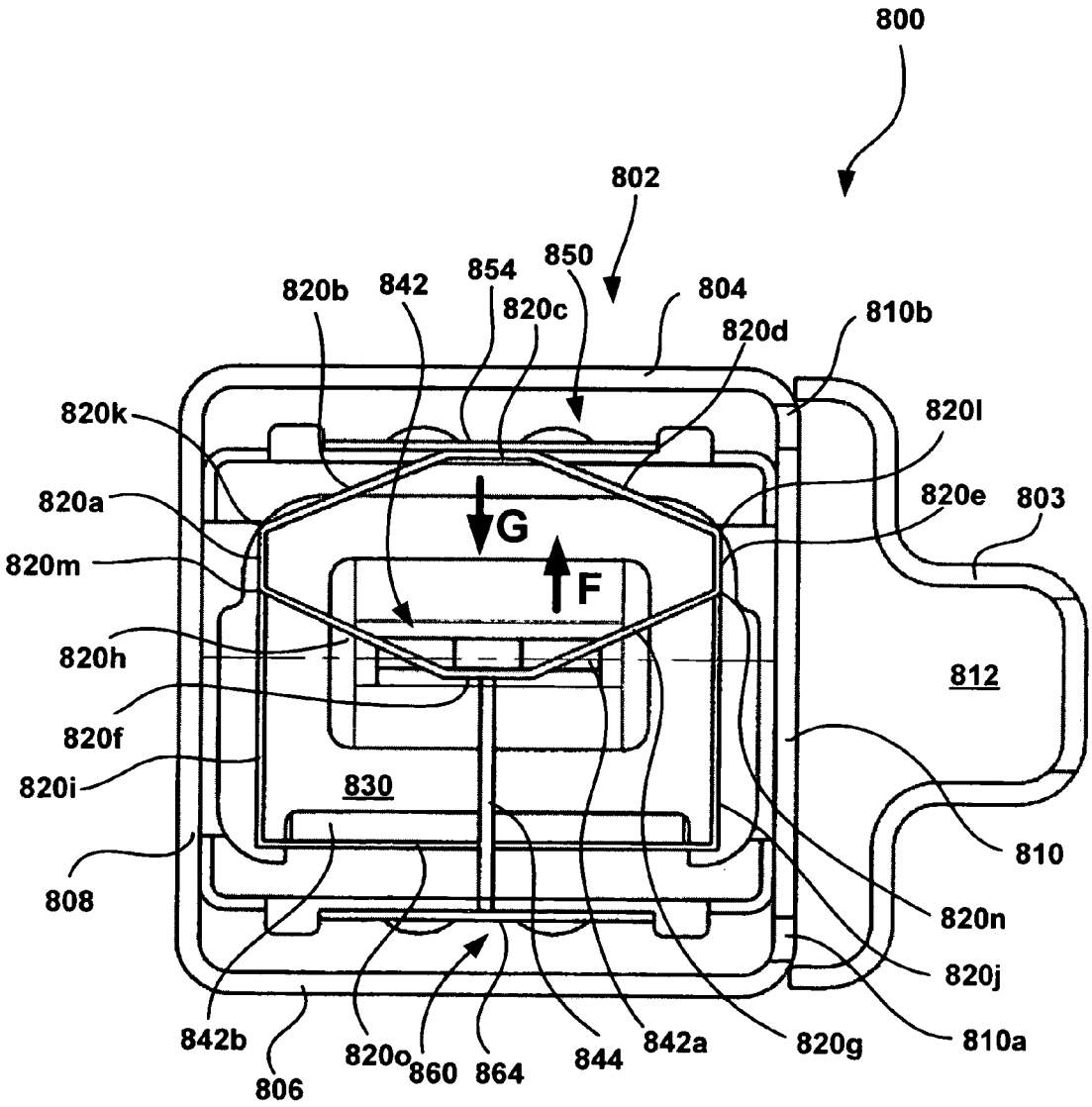
FIG. 11 is a front view of another described embodiment of a receiver assembly.

FIG. 11 illustrates another embodiment of a receiver assembly. The assembly 800 is similar in construction and function as the assembly 500 illustrated in FIG. 8, and similar elements are referred to using like reference numerals wherein, for example 800 and 850 correspond to 500 and 550, respectively. In this embodiment, acoustic ports 810*a*, 810*b* are introduced on a side wall 810 to broadcast an output acoustical signal that corresponds to an audio signal that is transmitted into the receiver assembly 800 via electrical terminal (not depicted). A sound outlet tube 803 corresponding to the acoustic ports 810*a*, 810*b* may be coupled to the side wall 810 of the housing 802. In an alternate embodiment, the acoustic ports 810*a*, 810*b* can be formed on the side wall 808, and the sound outlet tube 803 could be coupled to the side wall 808.

As shown in FIG. 11, a linkage assembly 820 is shown generally quadrilateral, having a plurality of link members 820*a*, 820*b*, 820*c*, 820*d*, 820*e*, 820*f*, 820*g*, 820*h*, 820*i*, 820*j*, 820*o* and vertices 820*k*, 820*l*, 820*m*, 820*n*. The linkage assembly 820 may take the form of various shapes (e.g., elliptical-like shape such as elongate circle, oval, ellipse, hexagon, octagon, circle, etc.). The link members 820*a*, 820*b*, 820*c*, 820*d*, 820*e*, 820*f*, 820*g*, 820*h*, 820*i*, 820*j*, 820*o* are coupled together at vertices 820*k*, 820*l*, 820*m*, 820*n*. The transitions from one member to its neighbor may be abrupt and sharply angled such as vertices 820*k*, 820*l*, 820*m*, 820*n*, or may be curved or expanded and include at least one short span, such as members 820*a*, 820*c*, 820*e*, 820*f*. A drive rod 844 may be coupled to the linkage assembly 820. Also, the linkage assembly 820 and the drive rod 844 can be formed from the same stock and molded or press-fit to the linkage 820 to form one unit. The diaphragm assemblies 850, 860 may be secured to an inner surface of a top portion 804 and an inner surface of a bottom portion 806 by bonding or any other suitable method. In an alternate embodiment, the diaphragm assemblies 850, 860 can be secured to the outer surface of a magnet assembly 830 by bonding or any other suitable method of attachment. The diaphragm assemblies 850, 860 and the armature 842 are coupled to the linkage assembly 820. An inner surface of the first diaphragm assembly 850 is coupled to the linkage assembly 820 at or near the link member 820*c* by bonding or any other suitable method of attachment. An inner surface of the second diaphragm assembly 860 is coupled to one end of the drive rod 844. Another end of the drive rod 844, in turn, is coupled to linkage assembly 820 at or near the link member 820*f* by bonding or any other suitable method. A free end of an armature leg 842*a* is coupled to the linkage assembly 820 at or near the link member 820*f*. The motion of the vertices 820*a*, 820*e* of the linkage assembly 820 is partially constrained by link members 820*i*, 820*j*, 820*o* of the linkage assembly 820, thus restricting movement of the vertices 820*a*, 820*e* in directions parallel to the directions F and G. As an example, upward vertical movement by the first armature leg 842*a* in the direction F generates a downward vertical movement of link member 820*c*, resulting in downward vertical movement of the diaphragm 854 in the direction G. Upward vertical movement by the first armature leg 842*a* in the direction F generates upward vertical movement of the drive rod 844, resulting in upward vertical movement of the second diaphragm assembly 860 in the direction F. The opposing motions of the armature 842, and the diaphragms 854, 864 enable the vibration balancing of the receiver 800 over a wide frequency range. In an alternate embodiment, the moving mass of at least one of the diaphragm assemblies 850, 860, such as the first diaphragm assembly 850 can be increased to be substantially equal to the moving mass of the second diaphragm assembly 860, the moving mass of the drive rod 844, and the moving mass of armature leg 842*a* to further reduce vibration of the receiver assembly 800. Also, an additional mass could be attached, for example, to the link 820*c*.

Figure 12:
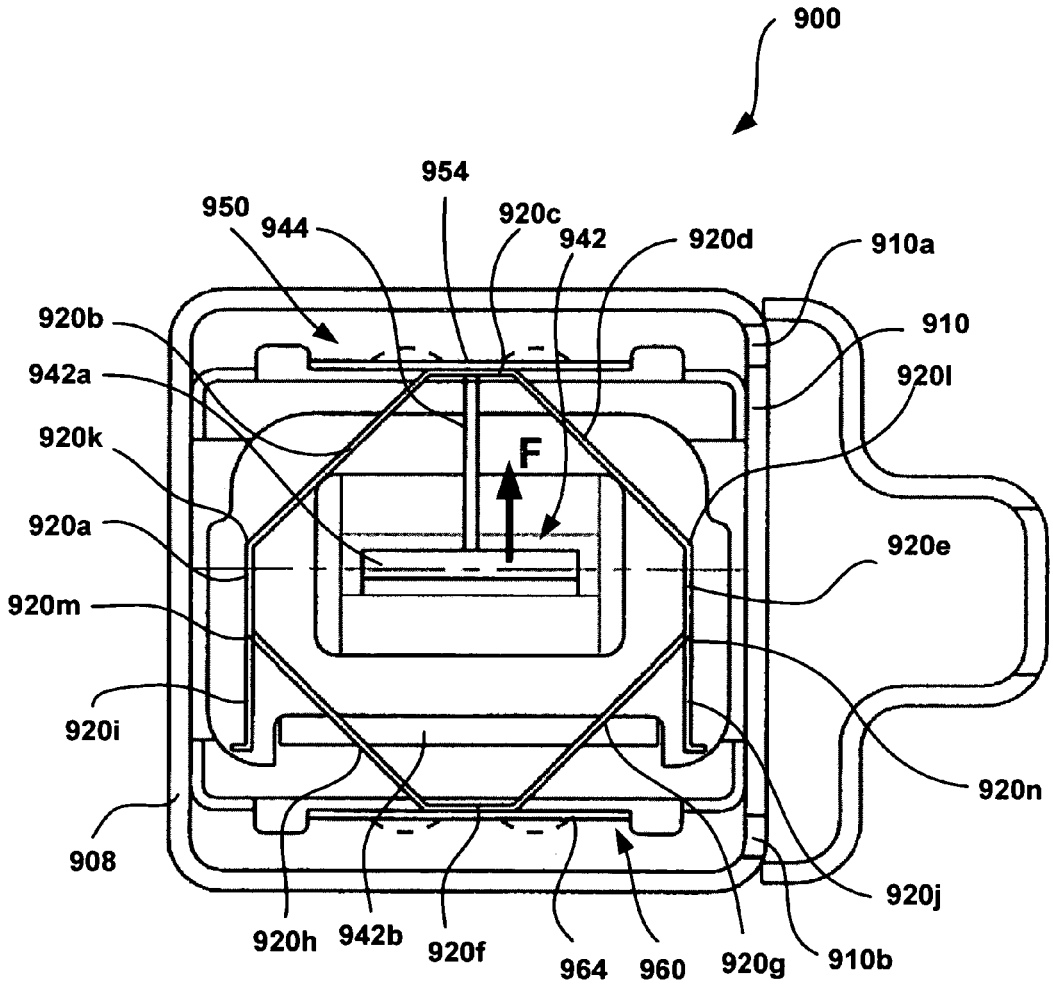
FIG. 12 is a front view of another described embodiment of a receiver assembly.

Referring now to FIG. 12, a receiver assembly 900 in accordance with a described embodiment of the invention. The assembly 900 is similar in construction and function as the assembly 800 illustrated in FIG. 11, and similar elements are referred to using like reference numerals wherein, for example 900 and 950 correspond to 800 and 850, respectively. In this embodiment, a linkage assembly 920 is shown generally quadrilateral, having a plurality of link members 920*a*, 920*b*, 920*c*, 920*d*, 920*e*, 920*f*, 920*g*, 920*h*, 920*i*, 920*j* and vertices 920*k*, 920*l*, 920*m*, 920*n*. The linkage assembly 920 may take the form of various shapes (e.g., elliptical-like shape such as elongate circle, oval, ellipse, hexagon, octagon, circle, etc.). The members 920*a*, 920*b*, 920*c*, 920*d*, 920*e*, 920*f*, 920*g*, 920*h*, 920*i*, 920*j* and connected together at the vertices 920*k*, 920*l*, 920*m*, 920*n*. The transitions from one member to its neighbor may be abrupt and sharply angled such as vertices 920*k*, 920*l*, 920*m*, 920*n* compared to FIG. 8, or may be expanded and include at least one short span, such as members 920*a*, 920*c*, 920*e*, 920*f*. A drive rod 944 may be coupled to the linkage assembly 920. Also, the linkage assembly 920 and the drive rod 944 can be formed from the same stock and molded or press-fit to the linkage 920 to form one unit. The diaphragm assemblies 950, 960 may be coupled to an inner surface of a side portion 908 and an inner surface of a side portion 910 by bonding with adhesive. In alternate embodiment, the diaphragm assemblies 950, 960 can be secured to an outer surface of a magnet assembly 930 by bonding with adhesive. The diaphragm assemblies 950, 960 and the armature 942 are coupled to the linkage assembly 920. The inner surface of the first diaphragm assembly 950 is coupled to the linkage assembly 920 at or near the link member 920*c* by bonding or any other suitable method. One end of the drive rod 944 couples to a free end of an armature leg 942*a*. The other end of the drive rod 944 is coupled to an inner surface of the link member 920*c* by bonding or any other suitable method. An inner surface of the second diaphragm assembly 960 is coupled to the linkage assembly 920 at or near the link member 920*g*. The motion of the vertices 920*a*, 920*e* of the linkage assembly 920 is partially constrained by legs 920*i*, 920*j* of the linkage assembly 920, thus restricting movement of the vertices 920*a*, 920*e* in the direction generally parallel to F and in a direction opposite to F. As an example, upward vertical movement by the armature leg 942*a* in the direction F generates upward vertical movement of the drive rod 944, resulting in upward vertical movement of the diaphragm 954 via the upward vertical movement of the link member 920*c* in the direction F. Upward vertical movement by the first armature leg 942*a* generates downward vertical movement of link member 920*f*, resulting in downward vertical movement of the diaphragm 964. The opposing motions of the armature 942, and the diaphragms 954, 964 enables the vibration balancing of the receiver 900 over a wide frequency range. In an alternate embodiment, the moving mass of at least one of the diaphragm assemblies 950, 960, such as the second diaphragm assembly 960 can be increased to be substantially equal to the moving mass of the first diaphragm assembly 950, the moving mass of the drive rod 944, and the moving mass of armature leg 842*a* to further reduce vibration of the receiver assembly 900. Also, an additional mass could be attached, for example, to the link 920*f*.

In the embodiments described above with respect to FIGS. 8-12, two in-phase diaphragms are used. Thus, in these embodiments, it may be possible to increase the radiating area as compared to a receiver utilizing only one diaphragm. Also, it may be possible to generate a greater acoustical output as compared to a receiver utilizing only one diaphragm. Further, it may be possible to generate a similar acoustical output using less power as compared to a receiver utilizing only one diaphragm. In some implementations, a receiver assembly utilizing two in-phase diaphragms may not provide any of these advantages, but rather may provide different advantages.

Although various linkage assemblies have been described above and shown in the figures having link members of particular relative lengths, as well as ratios between lengths of link members, one of ordinary skill in the art will recognize that the relative lengths and ratios of lengths of link members may be varied in different implementations.

What is claimed is:

1. A receiver assembly comprising:

a housing having a fixed housing portion and a moveable housing portion;

a flexible membrane disposed between the fixed housing portion and the movable housing portion, wherein the flexible membrane is adapted to allow relative motion between the fixed and moveable housing portions and to enclose the fixed and moveable housing portions to provide an enclosed housing;

a magnetic motor assembly positioned within the enclosed housing and including a displaceable drive rod; and a link assembly disposed within the enclosed housing having a first end fixedly attached to an inner surface of the moveable housing and a second end coupled to the drive rod, wherein the link assembly translates the moveable housing portion relative to the fixed housing portion in response to the displacement of the drive rod;

wherein the flexible membrane defines a bellows-like member adapted to flex between a compressed position and an extended position.

2. The receiver assembly of claim 1, wherein the flexible membrane is an accordion shaped connector.

3. The receiver assembly of claim 1, wherein the flexible membrane is a pliant sheet of material.

4. The receiver assembly of claim 1, wherein the flexible membrane is a formed integral with the housing.

5. The receiver assembly of claim 1, wherein the flexible membrane is a separate component disposed between and joins the fixed housing portion to the moveable housing portion.

6. The receiver assembly of claim 1, wherein the link assembly further comprises a first link including the first end and a second link including the second end, the first and second links flexibly connecting the drive rod to the inner surface of the moveable housing portion.

7. The receiver assembly of claim 1, wherein the first end of the link assembly fixed attached to a diaphragm member positioned adjacent to the inner surface of the moveable housing portion.

8. The receiver assembly of claim 1, wherein the link assembly is manufactured from a metallic rigid flat stock.

9. A receiver assembly including a magnetic motor assembly having a drive rod mounted to a free end of a translatable armature, the receiver assembly comprising:

an enclosed housing with the magnetic motor assembly being disposed within the enclosed housing, the enclosed housing including a flexible membrane arranged to divide the housing into a fixed housing portion and a moveable housing portion; and a link assembly disposed within the enclosed housing including:

a first link member coupled to the drive rod; and a second link member flexibly coupled to the first link member and fixedly attached to the moveable housing portion;

wherein the first and second link members cooperate to translate the moveable housing portion relative to the fixed housing portion in response to the movement of the armature and drive rod.

10. The receiver assembly of claim 9, wherein the flexible membrane is an accordion shaped connector.

11. The receiver assembly of claim 9 further comprising at least one raised formation positioned to restrict the translation of the armature and the coupled drive rod.

12. The receiver assembly of claim 9, wherein the link assembly further comprises a third link member fixedly attached to a fixed end of the translatable armature and a fourth link member flexibly coupled to the third link member and fixedly attached to the moveable housing portion, wherein the third and fourth link members balance the first and second link members during the translation of the moveable housing portion.

13. The receiver assembly of claim 9, wherein a fifth link member flexibly coupled the fourth link member to the second link member, wherein the fifth link member fixedly attached to a diaphragm member positioned within the moveable housing portion.

14. The receiver assembly of claim 9, wherein the link assembly is manufactured from a metallic rigid flat stock.

15. A receiver assembly comprising:

a sealed housing having a fixed housing portion adapted to enclose a magnetic motor assembly including a displaceable drive rod; and a moveable housing portion flexibly attached to the fixed housing portion by a flexible membrane; and a link assembly having a first end fixedly attached to an inner surface of the moveable housing and a second end coupled to the drive rod, wherein the link assembly translates the moveable housing portion relative to the fixed housing portion in response to the displacement of the drive rod;

wherein the flexible membrane defines a bellows-like member adapted to flex between a compressed position and an extended position.

16. The receiver assembly of claim 15, wherein the link assembly is manufactured from a rigid flat stock.

17. The receiver assembly of claim 16, wherein the rigid flat stock is a metallic material.

18. The receiver assembly of claim 16, wherein the rigid flat stock is a plastic material.

19. The receiver assembly of claim 15, wherein the moveable housing portion includes a diaphragm member.

20. A receiver assembly comprising:

a sealed housing having a fixed housing portion adapted to enclose a magnetic motor assembly including a displaceable drive rod; and a moveable housing portion flexibly attached to the fixed housing portion by a flexible membrane; and a link assembly having a first end fixedly attached to an inner surface of the moveable housing and a second end coupled to the drive rod, wherein the link assembly translates the moveable housing portion relative to the fixed housing portion in response to the displacement of the drive rod;

the magnetic motor assembly includes an armature adapted to displace the drive rod in a substantially vertical manner.

21. The receiver assembly of claim 20, wherein the vertical displacement of the armature is constrained by at least one formation positioned adjacent to an armature free end.

22. The receiver assembly of claim 20, wherein the link assembly is manufactured from a rigid flat stock.

23. The receiver assembly of claim 22, wherein the rigid flat stock is a metallic material.

24. The receiver assembly of claim 22, wherein the rigid flat stock is a plastic material.

25. The receiver assembly of claim 20, wherein the moveable housing portion includes a diaphragm member.

* * * * *